United States Patent [19]

Smith

[11] Patent Number: 4,529,386

[45] Date of Patent: Jul. 16, 1985

[54] BOW MOTOR ASSEMBLY

[76] Inventor: David N. Smith, 7216 Boone Ave. North, Minneapolis, Minn. 55428

[21] Appl. No.: 453,752

[22] Filed: Dec. 27, 1982

[51] Int. Cl.[3] ..... B63H 5/12

[52] U.S. Cl. ..... 440/54; 440/6

[58] Field of Search ..... 440/6, 7, 53, 54; 403/43; 254/98–103; 244/102 A, 102 R

[56] References Cited

U.S. PATENT DOCUMENTS

| | | | |
|---|---|---|---|
| 1,786,997 | 12/1930 | Harvey | 440/54 |
| 2,151,004 | 3/1939 | Barclay | 440/54 |
| 2,442,456 | 6/1947 | Wiseman | 254/103 |
| 2,570,534 | 10/1951 | Erny | 244/102 R |
| 2,885,990 | 5/1959 | Hawthorne | 440/54 |
| 3,587,512 | 6/1971 | Patterson | 440/54 |
| 3,685,481 | 8/1972 | Monsell | 440/54 |
| 3,807,347 | 4/1974 | Baldwin | 440/54 |
| 3,873,066 | 3/1975 | Opyrchal | 254/103 |
| 4,017,198 | 4/1977 | Mason | 403/43 |
| 4,226,206 | 10/1980 | Wilson | 440/112 |

OTHER PUBLICATIONS

Brochure—MINN KOTA MOTORS—Minn Kota Motors, 1531 Madison Avenue, Mankato, Minn. 56001.

*Primary Examiner*—Trygve M. Blix
*Assistant Examiner*—Edwin L. Swinehart
*Attorney, Agent, or Firm*—Burd, Bartz & Gutenkauf

[57] ABSTRACT

A boat is equipped with a motor assembly mounted on a housing in the bow of the boat. A power driven drive operates to move the propeller drive of the motor up into and down out of the housing. A pair of doors hinged to the bow and connected to the motor are moved to closed positions when the propeller drive is located on the housing and located in open positions when the propeller drive is moved to its down position.

20 Claims, 7 Drawing Figures

BOW MOTOR ASSEMBLY

SUMMARY OF THE INVENTION

The invention pertains to a boat and motor assembly wherein the motor shaft and propeller assembly of a boat motor extend and retract relative to the boat hull. The boat motor can be the primary or a secondary source of motive power for the boat. For example, fisherman frequently use boats having two outboard motors, one larger motor for rapid transport from place to place, and a smaller, frequently electrically powered motor for trolling at the fishing site or for other slow movement. The presence of an unused motor shaft and propeller assembly in the water creates additional drag working against movement of the boat. In shallow water or when beaching a boat, the downwardly extended propeller shaft must be considered. Frequently, sailboats are powered by auxiliary motors which, when not in use, have propeller shafts located in the water and creating additional drag.

According to the present invention, there is provided a boat and motor assembly wherein the boat motor can be a primary or secondary motive force for the boat. The motor can be of the electrically powered variety and is mounted with the motor shaft housing and propeller assembly extendable and retractable with respect to the boat hull. A housing mounted on the inside of the boat near the bow forms a compartment to store the lower shaft and propeller assembly of the motor when not in use. Lower edges of the sidewalls of the housing are in fluid sealing relationship to the floor of the boat. A compartment opening is provided centrally in the boat hull open to the compartment. Compartment doors are provided for closing the compartment opening. The motor shaft is movably mounted on the top wall of the housing for vertical movement so that the propeller assembly is movable from an extended position with the propeller shaft extending through the compartment opening and the propeller in operative position beneath the hull of the boat, to a retracted position with the propeller assembly located in the compartment. The compartment doors are movable between open and closed position and are coupled to the motor shaft housing to move to the closed position when the motor is moved to the retracted position, and to move to the open position when the motor is moved toward the extended position. In the closed position, the compartment doors conform substantially to the shape of the hull whereby the compartment opening does not affect the hydrodynamic performance of the boat.

IN THE DRAWINGS

DESCRIPTION OF A PREFERRED EMBODIMENT

Figure 1:
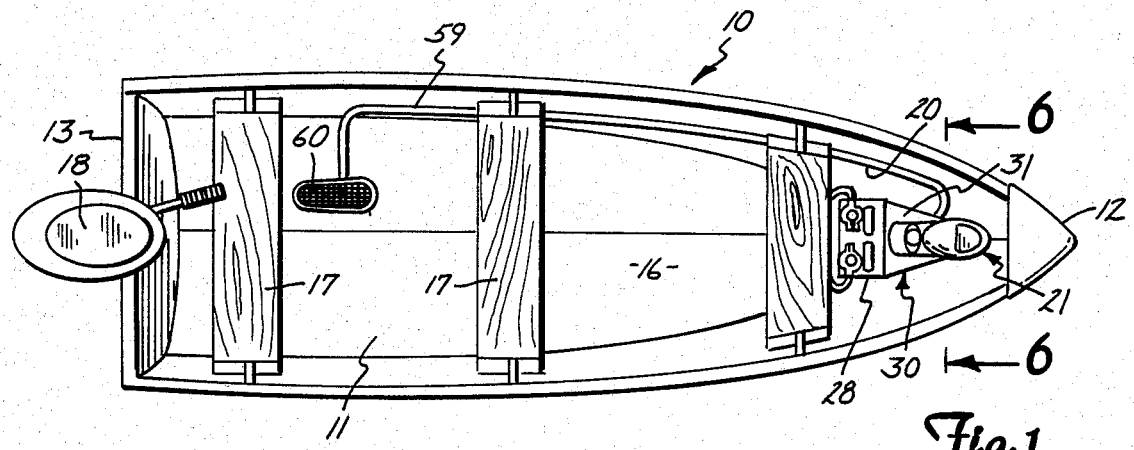
FIG. 1 is a top plan view of a boat and motor assembly according to the invention.
Figure 2:
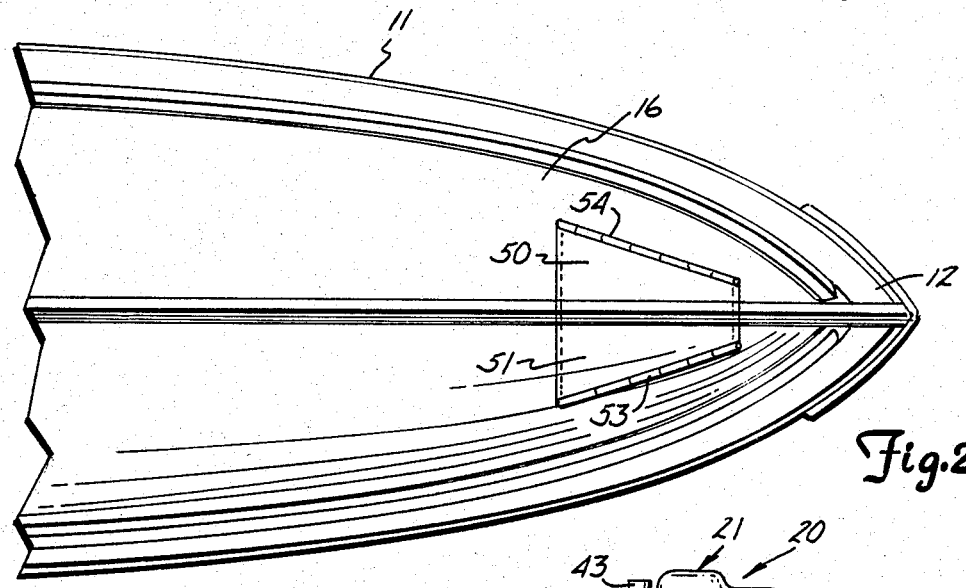
FIG. 2 is an enlarged bottom plan view of the forward portion of the boat and motor assembly of FIG. 1.

Referring to the drawings, there is shown in FIG. 1, a boat and motor assembly indicated generally at 10 comprising a boat 11 having a forward bow 12 and a stern defined by transverse upright transom 13. A gunnel 15 describes the upper edges of sidewalls of a boat hull 16. A plurality of transverse horizontal seats 17 extend between sidewalls of hull 16. An internal combustion outboard motor 18 mounted on transom 13 provides primary motive force for boat 11.

Figure 3:
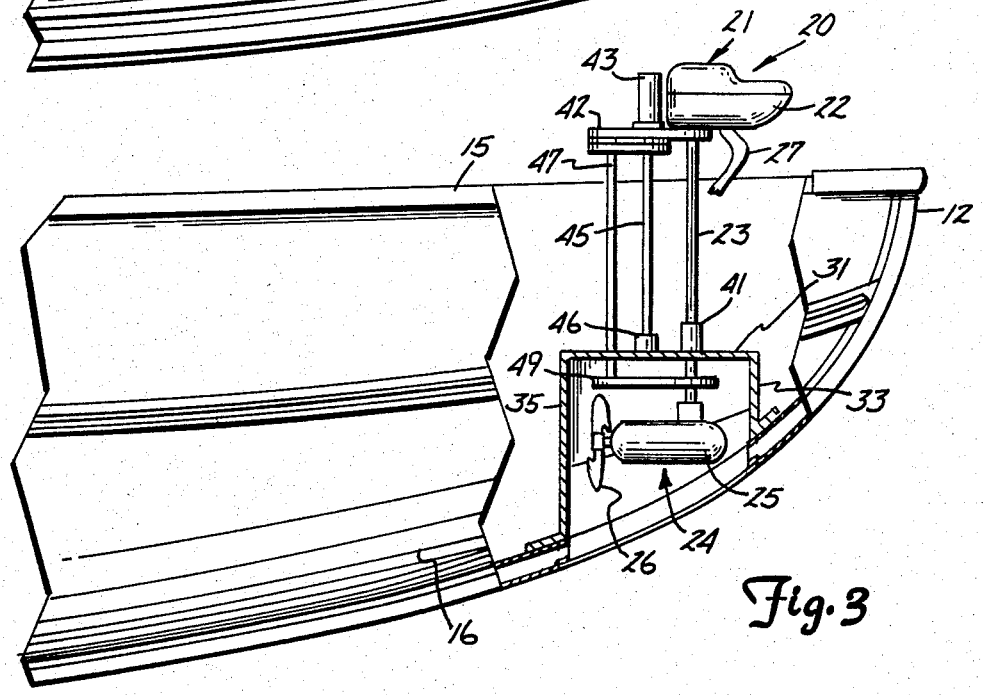
FIG. 3 is an enlarged side elevational view of the forward portion of the boat and motor assembly of FIG. 1 with portions removed for purposes of illustration.
Figure 4:
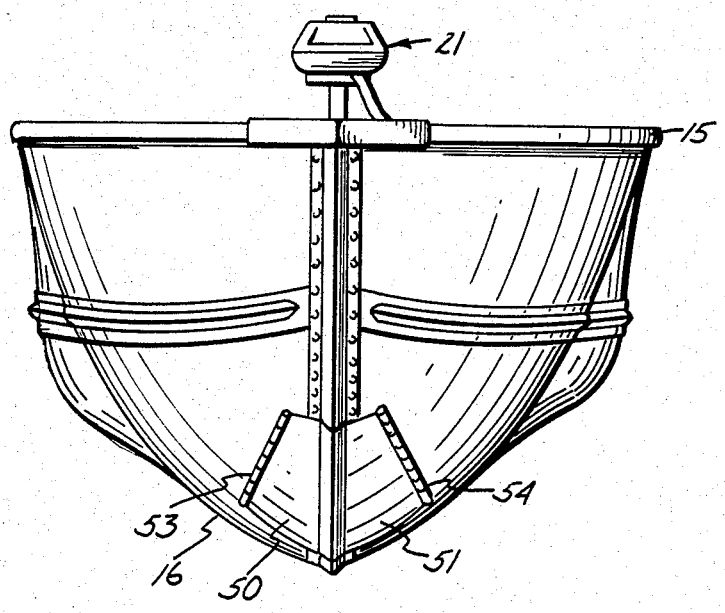
FIG. 4 is an enlarged front elevational view of the boat and motor assembly of FIG. 1.
Figure 5:
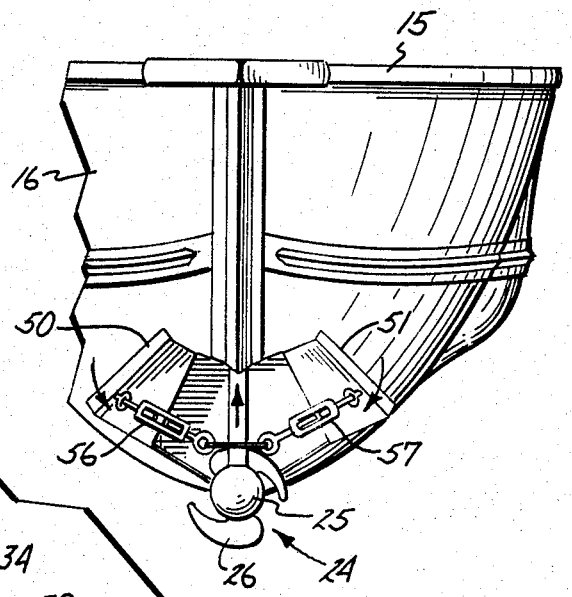
FIG. 5 is a fragmentary front elevational view of the boat and motor assembly of FIG. 4 with the motor in an extended position.

As shown in FIG. 3, bow motor assembly 20 mounted on hull 16 toward bow 12 includes an electrically powered outboard type motor 21 which serves as a secondary source of motive power for boat 11. Motor 21 includes a shroud 22 having various connections and controls, and a shaft 23 extending downwardly from shroud 22. A propeller assembly 24 includes an electric engine 25 assembled to the lower end of shaft 23 and connected to the shroud 22 by various electrical connections extending through the shaft 23 (not shown). Engine 25 drives a screw propeller 26. Electrical cables 27 connect motor 21 to an external electrical battery 28 for powering engine 25 to turn screw propeller 26. Other propeller assemblies such as a jet propeller could be used.

A box-like open bottom housing 30 with a trapezoidal top wall 31 and vertical sidewalls 32–35 located at bow 12 of boat 11 defines a retaining compartment 37 to store the lower portion of motor 21 when not in use. A compartment opening 38 is centrally formed in hull 16 substantially coextensive with the lower edges of sidewalls 32–35 of housing 30. The lower edges of the sidewalls 32–35 are curved to conform to the interior curvature of hull 16. A lip 39 extends outward from the lower edges of sidewalls 32–35 and is in fluid tight relationship with the edges of hull 16 adjacent compartment opening 38. Suitable fastening means as bolts or the like secure lip 39 to hull 16.

Figure 7:
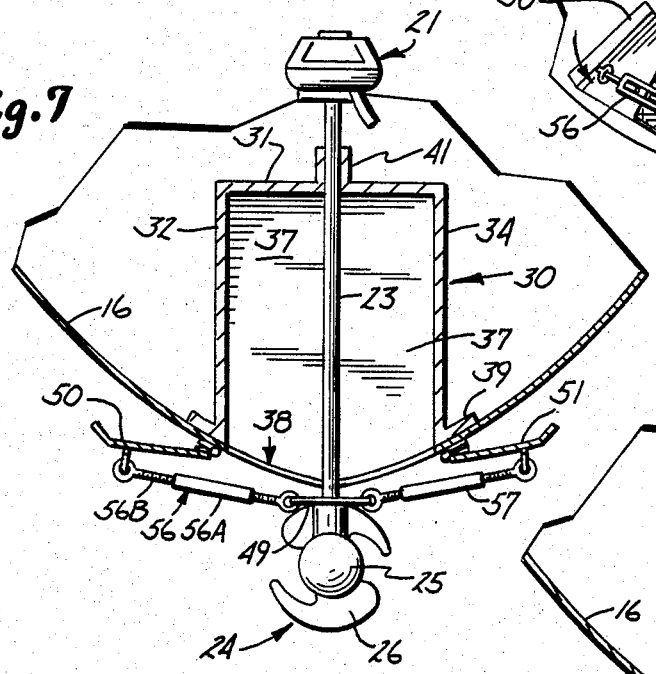
FIG. 7 is a sectional view like that of FIG. 6 but showing the motor in an extended position with the compartment doors open.

A tubular collar 41 extends upwardly from top wall 31 of housing 30. Shaft 23 of motor 21 is assembled in collar 41 for up and down movement therein, as well as pivotal movement about an upright axis. An upper mounting plate assembly 42 is pivotally assembled to the upper end of motor shaft 23. A drive mechanism for raising and lowering the outboard motor 21 includes an electric drive motor 43 fastened to plate assembly 42 and connected to the upper end of a threaded, rotatable drive shaft 45. The lower end of drive shaft 45 engages an interiorally threaded boss 46 located on the top wall 31 of housing 30. Rotation of the drive shaft 45 as when driven by the electric drive motor 43 is effective to move the upper mounting plate assembly 42 up and down relative to the housing top wall 31 and accordingly, move the electric motor 21 up and down. As shown in FIG. 3, electric motor 21 is movable to an up or retracted position wherein the propeller assembly 24 is located in compartment 37 of housing 30. The outboard motor 21 is movable to a down or extended position as shown in FIG. 7 wherein propeller assembly 24 is extended beneath the hull 16 of boat 1 in operative position to be energized to move the boat 11 through the water.

A guide bar 47 has an upper end also assembled to the upper mounting plate assembly 42. Guide bar 47 extends through a suitable guide opening provided in the top wall 31 of housing 30 and has a lower end assembled to a lower mounting plate assembly 49. Lower plate assembly 49 is also fastened to the lower end of motor shaft 23 for purposes of stability of the bow motor assembly.

Closure means are provided to close compartment opening 38 when motor 21 is in the retracted position. A pair of symmetrical compartment doors 50, 51 are connected by elongate hinges 53, 54 to the edges of hull 16 adjacent compartment opening 38. Doors 50, 51 are shaped to conform generally to the shape of hull 16 when in the closed position and have edges that come together generally in alignment with the keel of hull 16.

Figure 6:
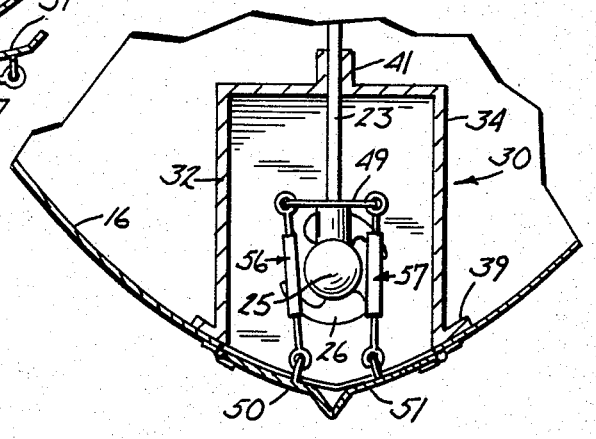
FIG. 6 is an enlarged sectional view of a portion of the boat and motor assembly of FIG. 1 taken along the line 6—6 thereof.

Compartment doors 50, 51 are linked to shaft 23 of motor 21 for opening and closing as motor 21 is extended and retracted. As shown in FIGS. 6 and 7, a first link 56 is pivotally connected at one end to the interior surface of first door 50, and pivotally connected at the opposite end to the lower mounting plate assembly 49. A second link member 57 is pivotally connected at one end to the interior surface of second door 51 and at the opposite end to the lower mounting plate assembly 49. Upon raising of motor 21, link assemblies 56, 57 pull compartment doors 50, 51 to the closed position as shown in FIG. 6. Upon lowering of the motor 21, link members 56, 57 push compartment doors 50, 51 to the open position of FIG. 7. As shown in FIG. 7, a link member 56 can be comprised of a turnbuckle assembly having a turnbuckle yoke 56A and threaded, outwardly extended turnbuckle arms 56B threadably connected to the yoke.

In operation, drive motor 43 is used to lower outboard motor 21 to an operative position relative to hull 16 of boat 11. As the motor is lowered, the compartment doors 50, 51 are opened by the link members 56, 57. Electric motor 21 can then be operated by remote control assembly 59 having a foot pedal 60 to control speed and direction as is known in the art. The boat operator can then troll or otherwise proceed slowly through the water. Upon completion, drive motor 43 is operated to lift the outboard motor 21 to the point where the lower shaft portion 23, engine 25 and screw propeller 26 are stored in the compartment 37. At the same time that the shaft is retracted, the link members 56, 57 draw the compartment doors 50, 51 to the closed position. Primary motive source 18 is then operated to move the boat through the water.

Modifications and variations of the structure of the housing, compartment doors, secondary boat propulsion device and linkage operably connecting the propulsion device to the doors may be made by one skilled in the art without departing from the scope of the present invention. It is understood that the invention may be practiced otherwise than as specifically described.

The embodiments of the invention in which an exclusive property or privilege is claimed are defined as follows:

1. A boat and motor assembly wherein a boat motor has a motor shaft carrying a propeller assembly that is selectively extendable and retractable relative to the boat hull, comprising: a boat having a hull with a compartment opening in the bottom thereof; a boat motor of the type having a motor shaft and a propeller assembly at the lower end of the motor shaft; a housing located on said hull and defining a retaining compartment, said compartment opening of the hull being open to the retaining compartment of the housing; means mounting the boat motor on the housing with the motor shaft extending into the compartment; means to raise and lower the motor shaft between a first up position with the propeller assembly located in the compartment and a second down position with a portion of the motor shaft extended through the compartment opening and with the propeller assembly located beneath the hull in position to provide motive force to the boat; cover means attached to the hull movable between a closed position in covering relationship to the compartment opening, and an open position in clearing relationship to the compartment opening; said cover means including a first cover having a first edge and a second edge and a second cover having a first edge and a second edge, first means pivotally connecting the first edge of the first cover to said hull adjacent one side of the opening therein for movement between open and closed positions, second means pivotally connecting the first edge of the second cover to said hull adjacent the side opposite said one side of the opening therein for movement between open and closed positions, said second edges of the first and second covers being engageable with each other when they are in said closed positions, means interconnecting the boat motor and the first and second covers whereby when the motor shaft and propeller assembly are moved to the second position, the first and second covers pivot to the open positions, and when the motor shaft and propeller assembly are moved to the first position, the first and second covers pivot to the closed positions, said means interconnecting the boat motor and the cover means including a first link pivotally connected at one end thereof to the motor and at the opposite end to the first cover adjacent the second edge of the first cover, and a second link pivotally connected at one end thereof to the motor and at the opposite end to the second cover adjacent the second edge of the second cover whereby movement of the motor in a downward direction pivots the first and second covers to the open positions and movement of the motor in an upward direction pivots the first and second covers from the open positions to the closed positions locating the propeller assembly in the compartment, said first and second links being located in generally upright positions adjacent opposite sides of the propeller assembly when the first and second covers are in the closed positions to hold said first and second covers in said closed positions.

2. The boat and motor assembly of claim 1 including: plate means mounted on the motor shaft above the propeller assembly, said one end of the first link being pivotally connected to said plate means, and said one end of the second link being pivotally connected to said plate means.

3. The boat and motor assembly of claim 2 including: first means pivotally connecting the opposite end of the first link to the first cover between the first and second edge thereof, and second means pivotally connecting the opposite end of the second link to the second cover between the first and second edge thereof.

4. The boat and motor assembly of claim 1 wherein: said first and second links are comprised as turnbuckle assemblies.

5. The boat and motor assembly of claim 1 wherein:

said housing has sidewalls with lower edges in fluid tight contact with the interior surface of the hull, and a generally horizontal top wall, a tubular collar fixed to the top wall, said motor shaft being assembled in said tubular collar for up and down movement therein.

6. The boat and motor assembly of claim 5 wherein: said means to raise and lower the motor shaft includes a drive motor fixed for movement with the boat motor shaft, an exteriorally threaded drive shaft connected to and rotatable by the drive motor, an interiorally threaded boss located on the housing top wall, said drive shaft being in threaded engagement with the boss whereby operation of the drive motor to rotate the drive shaft selectively moves the boat motor shaft up and down.

7. The boat and motor assembly of claim 6 wherein: means connecting the boat motor shaft and the drive motor comprised at an upper mounting plate assembly, and including a guide bar having an upper end fixed to the upper mounting plate assembly and the lower end extended through a guide opening in the top wall of the housing.

8. The boat and motor assembly of claim 7 including: a lower mounting plate assembly located in the housing and connecting the lower ends of the guide bar and the boat motor shaft.

9. The boat and motor assembly of claim 1 wherein: said first and second covers are contoured to generally conform to the shape of the hull when in the closed positions.

10. The boat and motor assembly of claim 1 including: first means pivotally connecting the opposite end of the first link to the first cover between the first and second edge thereof, and second means pivotally connecting the opposite end of the second link to the second cover between the first and second edge thereof.

11. The boat and motor assembly of claim 1 wherein: said boat has a bow and said housing is positioned in the bow of the boat.

12. The boat and motor assembly of claim 11 wherein:

said propeller assembly includes a screw propeller.

13. The boat and motor assembly of claim 12 including:

means for pivoting the boat motor about in upright axis to steer the boat.

14. Apparatus for mounting a boat motor of the type having a shaft and a propeller assembly at the end of the shaft, on a boat having a hull, for raising and lowering the boat motor relative to the boat, comprising: a housing mounted on the bottom of the hull on the interior surface thereof and defining a compartment, said hull having a compartment opening open to the compartment of the housing; means for mounting the boat motor on the housing with the propeller assembly and motor shaft extended into the compartment; means to raise and lower the motor shaft between a first up position with the propeller assembly located in the compartment and a second down position with a portion of the motor shaft extended through the compartment opening and with the propeller assembly located beneath the hull in position to provide motive force to the boat; cover means pivotally connected to the hull for pivotal movement between a closed position in covering relationship to the compartment opening, and an open position in clearing relationship to the compartment opening: plate means mounted on the shaft means above the propeller assembly, link means connected to the plate means and cover means, and means pivotally connecting the link means to the cover means remote from the pivotal connection of the cover means to the hull whereby when the motor shaft and propeller assembly are moved to the second position, the cover means is moved to the open position, and when the motor shaft and propeller assembly are moved to the first position, the cover means is moved to the closed position and the link means is located in an upright position adjacent the propeller assembly.

15. The apparatus of claim 14 wherein:

said cover means includes a first cover and a second cover each pivotally connected to the hull on the outside thereof adjacent a hull edge adjacent said compartment opening, said first and second covers movable toward one another to the closed position, said first and second covers being contoured to generally conform to the shape of the hull when in the closed position, and movable away from one another to the open position.

16. The apparatus of claim 15 wherein: the link means includes a first link pivotally connected at one end to the first cover and connectable at the other end to the plate means, and a second link pivotally connected at one end to the second cover and pivotally connectable at the opposite end to the plate means whereby movement of the motor shaft towards the first position when connected to the first and second links pulls the first and second covers to the closed position and movement of the motor shaft toward the second position pushes the first and second covers toward the open position.

17. The apparatus of claim 16 wherein:

said housing has a generally horizontal top wall, a tubular collar fixed to the top wall, said motor shaft being assemblable in said tubular collar for up and down movement therein, said means to raise and lower the motor shaft including a drive motor fixable for movement with the boat motor shaft, an exteriorally threaded drive shaft connected to and rotatable by the drive motor, an interiorally threaded boss located on the housing top wall, said drive shaft being in threaded engagement with the boss whereby operation of the drive motor to rotate the drive shaft selectively moves the boat motor shaft up and down when fixed for movement with the drive motor.

18. The apparatus of claim 17 wherein:

means for connecting the boat motor shaft and the drive motor and includes an upper mounting plate assembly, and including a guide bar having an upper end fixed to the upper mounting plate assembly and a lower end extended through a guide opening in the top wall of the housing.

19. The apparatus of claim 18 including:

means for pivoting the boat motor about an upright axis to steer the boat when the boat motor shaft is mounted in the upper mounting plate assembly.

20. The apparatus of claim 15 wherein: said link means comprises a first link having an upper end and a lower end and a second link having an upper end and a lower end, said upper ends of the first and second links being pivotally connected to the plate means, said means pivotally connecting the link means to the cover means comprising first means secured to the first cover remote from the pivotal connection thereof to the hull pivotally connected to the lower end of the first link, and second means secured to the second cover remote from the pivotal connection thereof to the hull pivotally connected to the lower end of the second link, said first and second links being located in generally upright positions adjacent opposite sides of the propeller assembly when the first and second covers are in the closed positions to hold first and second covers in said closed positions.

* * * * *